United States Patent [19]

Bolton et al.

[11] 4,131,974

[45] Jan. 2, 1979

[54] FLOTATION STOLES

[75] Inventors: Colin B. Bolton, Fleet, England; Gerald P. Hermer, Jersey, Channel Islands

[73] Assignee: The Secretary of State for Defence in Her Britannic Majesty's Government of the United Kingdom of Great Britain and Northern Ireland, London, England

[21] Appl. No.: 712,874

[22] Filed: Aug. 9, 1976

[30] Foreign Application Priority Data

Aug. 8, 1975 [GB] United Kingdom ..... 33176/75

[51] Int. Cl.[2] ..... B63C 9/08

[52] U.S. Cl. ..... 9/337; 9/342; 9/314

[58] Field of Search ..... 9/336, 338, 337, 342, 9/348, 314; D34/43

[56] References Cited

U.S. PATENT DOCUMENTS

| | | | |
|---|---|---|---|
| D. 202,148 | 8/1965 | Geiszler | D34/43 |
| D. 217,036 | 3/1970 | Maxey | D34/43 |
| 1,478,351 | 12/1923 | O'Shaughnessy | 9/336 |
| 1,850,660 | 3/1932 | Coppel | 9/338 |
| 2,535,874 | 12/1950 | Starn | 9/342 |
| 2,692,994 | 11/1954 | King | 9/337 |
| 3,002,203 | 10/1961 | Moran | 9/338 |
| 3,360,813 | 1/1968 | Baker | 9/342 X |

*Primary Examiner*—Trygve M. Blix
*Assistant Examiner*—D. W. Keen
*Attorney, Agent, or Firm*—Cushman, Darby & Cushman

[57] ABSTRACT

A flotation stole having a chest portion of greater capacity at one side than the other so that it will invert an unconscious wearer who is face down in the water, even though the wearer may also be wearing clothing and an immersion suit and the stole being disposed to be symmetrical below the water level to ensure that the wearer may then lie in a substantially symmetrical configuration when face up in the water, that is without one shoulder being lower than the other.

9 Claims, 3 Drawing Figures

FLOTATION STOLES

The present invention relates to flotation stoles.

Since it has been realised that the personnel are more likely to die of exposure than drowning following an emergency at sea, immersion suits are being provided to confer some insulation to personnel in water. These, being impervious, are likely while assisting in keeping the person afloat to hinder the properties of traditional stoles to position the wearer with his face out of the water.

The present invention provides a flotation stole having a collar portion and a chest portion, the chest portion having a greater capacity at one side than the other so that the wearer face down in the water is subjected to sufficient turning moment to position him face up, even though he may be wearing clothing and an immersion suit, and the stole being constructed to be symmetrical in shape below what in use will be the water level, in order that the wearer may lie in a substantially symmetrical configuration when face up in the water, that is without one shoulder being lower than the other.

Of the inflatable stoles currently in use two particularly common are the collar and chest bag type and the halter type. The collar and chest bag type is somewhat rectangular in plan view with a head hole at one end. It is popular with seafarers. The halter type has a collar portion and two chest lobes. It is used by aircrew because of its stowability although in use it tends to aggravate any tendency for an oncoming wave to wash the wearer's face.

In a collar and chest bag stole according to the invention the chest bag may be arranged to have a somewhat trapezoidal cross section so that it is lop-sided in capacity. In a halter type stole according to the invention one chest lobe may have greater capacity than the other. In either type of stole one side of the chest portion may have between 20% and 100% greater capacity than the other side.

Either type of stole, especially the halter type, is advantageously shaped to conform to the wearer's chest in use.

A harness may be used to attach the stole to the wearer, and this advantageously comprises a belt with a link to the extremity of the chest portion or each lobe. The harness may also include a strap such that the back of the collar portion is connected to the lower part of the chest portion or each lobe to prevent the collar portion from pressing against the back of the wearer's head. Alternatively the stole may be housed in a pocket in a garment to include members wherewith it forms a jacket.

Typically the stole may have a single cavity and be inflatable perhaps by mouth or as is more usual in survival stoles, by gas such as air or carbon dioxide from a bottle.

The stole may be made from rubberised or plastic coated fabric and preferably from at least 3 sheets thereof, comprising, for example, a front panel, a back panel and a wall panel, and assembled by sticking overlapping edges with adhesive. By this means, the wall panel can be arranged to impart the body conforming facility and the protrusion profile, the rear panel can be arranged to control the displacement, and the front panel will supply the extra material for the protrusion.

Flotation stoles in accordance with the present invention will now be described by way of example with reference to the accompanying drawings of which:

Figure 1:
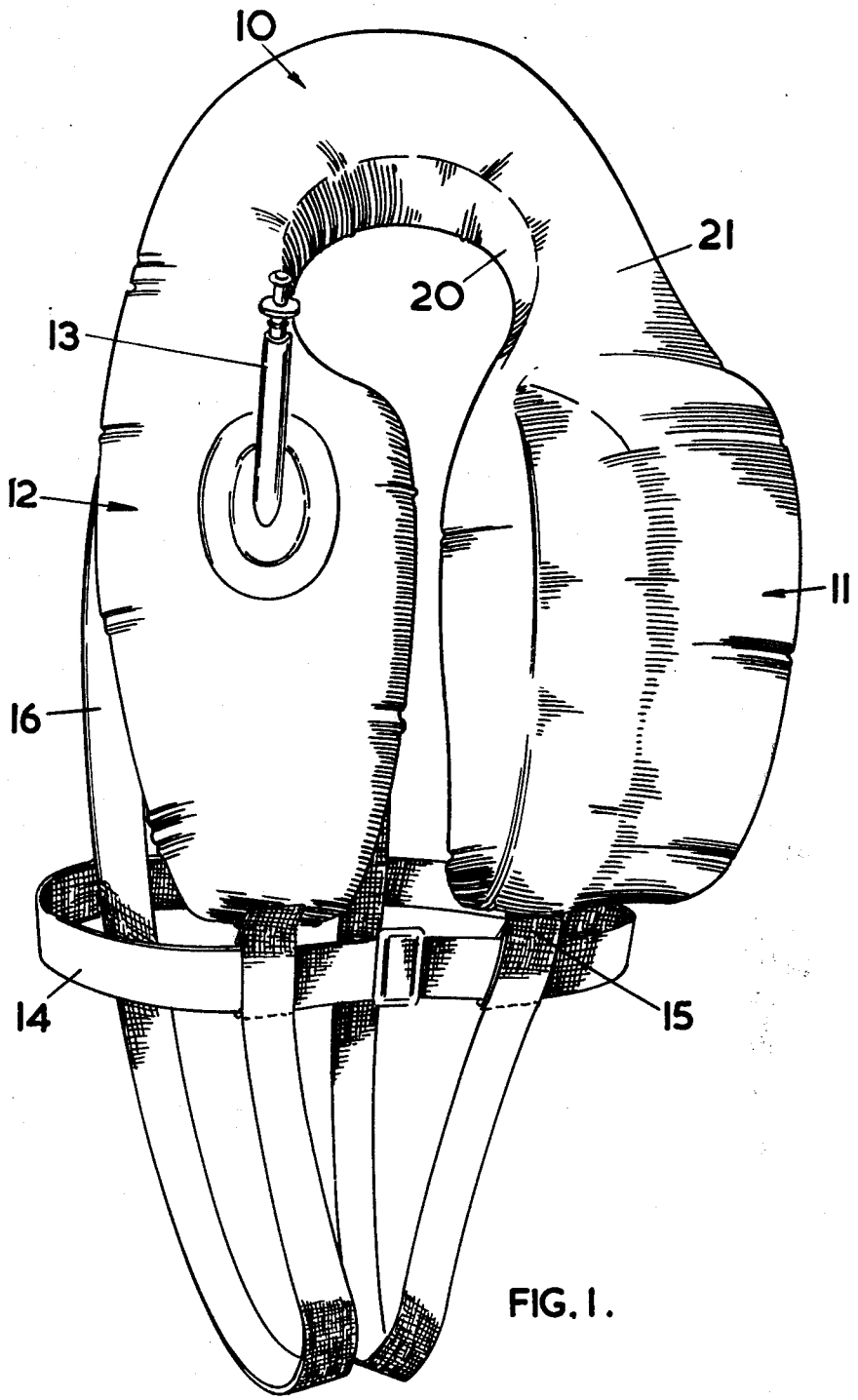
FIG. 1 is a three-quarters front view of a halter type stole.
Figure 2:
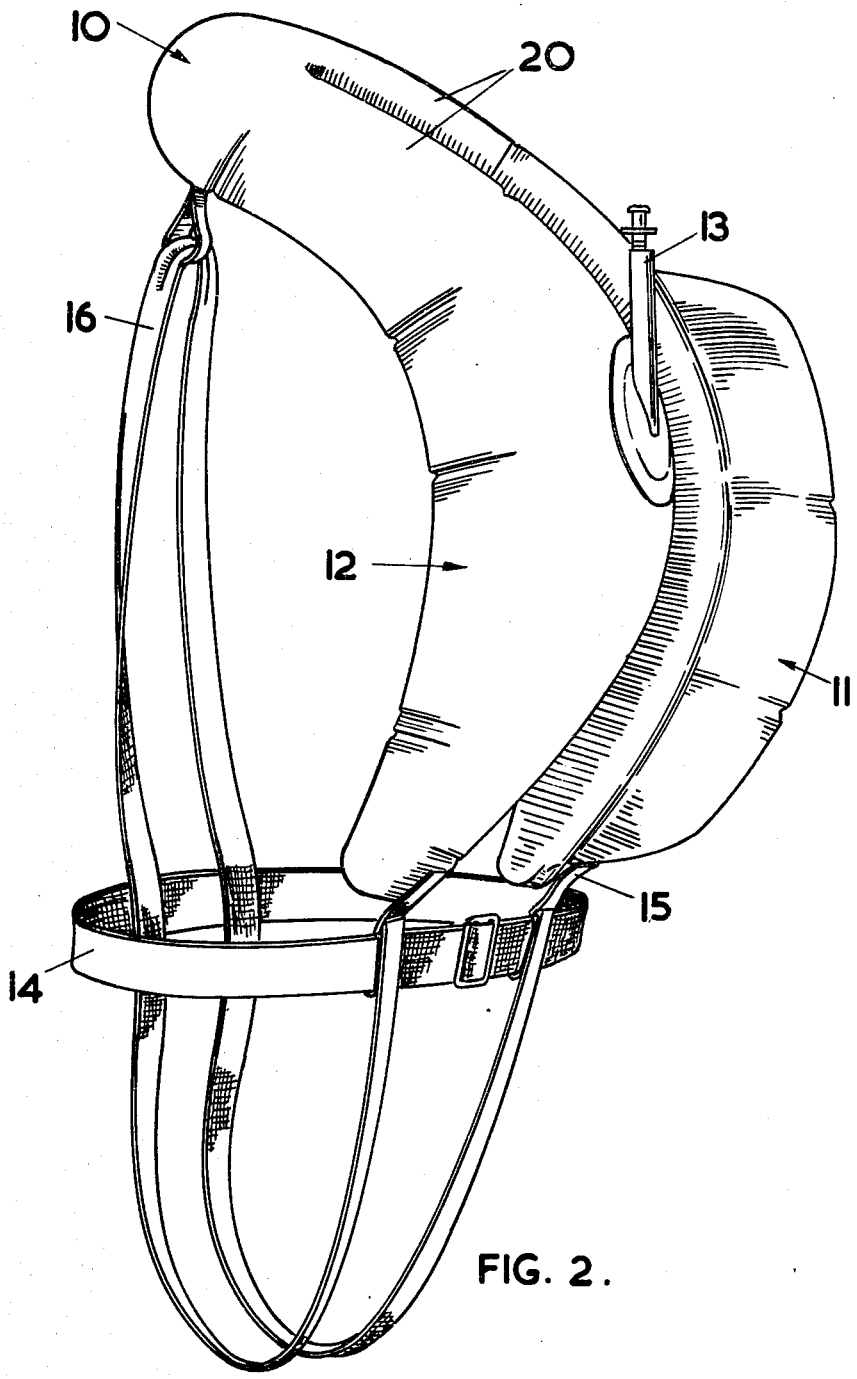
FIG. 2 is a side view thereof.

As shown in FIGS. 1 & 2 the halter type stole consists of a collar portion 10 and left and right chest lobes 11 and 12. The left lobe 11 is of larger capacity than the right and the right lobe 12 is fitted with a filler-tube 13 having a releasable non-return valve.

The stole is tailored as shown so that with the collar portion 10, passing around the neck when the stole is inflated, the lobes conform to the wearer's chest.

As can be seen in FIG. 1 the base, or bodyward region of the two lobes is similar and the increase in capacity of the left lobe is obtained in a forwardly protruding portion thereto.

A harness for retaining the stole to the wearer is also illustrated. It comprises a belt 14, links 15 therefrom to the lower extremities of the lobes 11 and 12, and collar portion securing straps 16 extending from the collar portion 10 to the back of the belt 14, thence forming a crutch sling which terminates at the links 15.

The stole is formed of 3 panels of rubberised fabric, viz a wall panel 20, a rear panel (not shown), and a front panel 21. The wall panel 20 is shaped to provide the body conforming facility and the different profiles of the two lobes 11 and 12. The rear panel, being substantially symmetrical, provides for equality of displacement of the two lobes and the front panel has the excess material for the left lobe protrusion. The panels have overlapping edges which are struck with adhesive to form a stole.

In a typical stole thus formed for use by an aircrewman, wearing full kit and a survival suit, the total capacity of the stole is 28 liters, with 5 liters more capacity to the left lobe than to the right.

Figure 3:
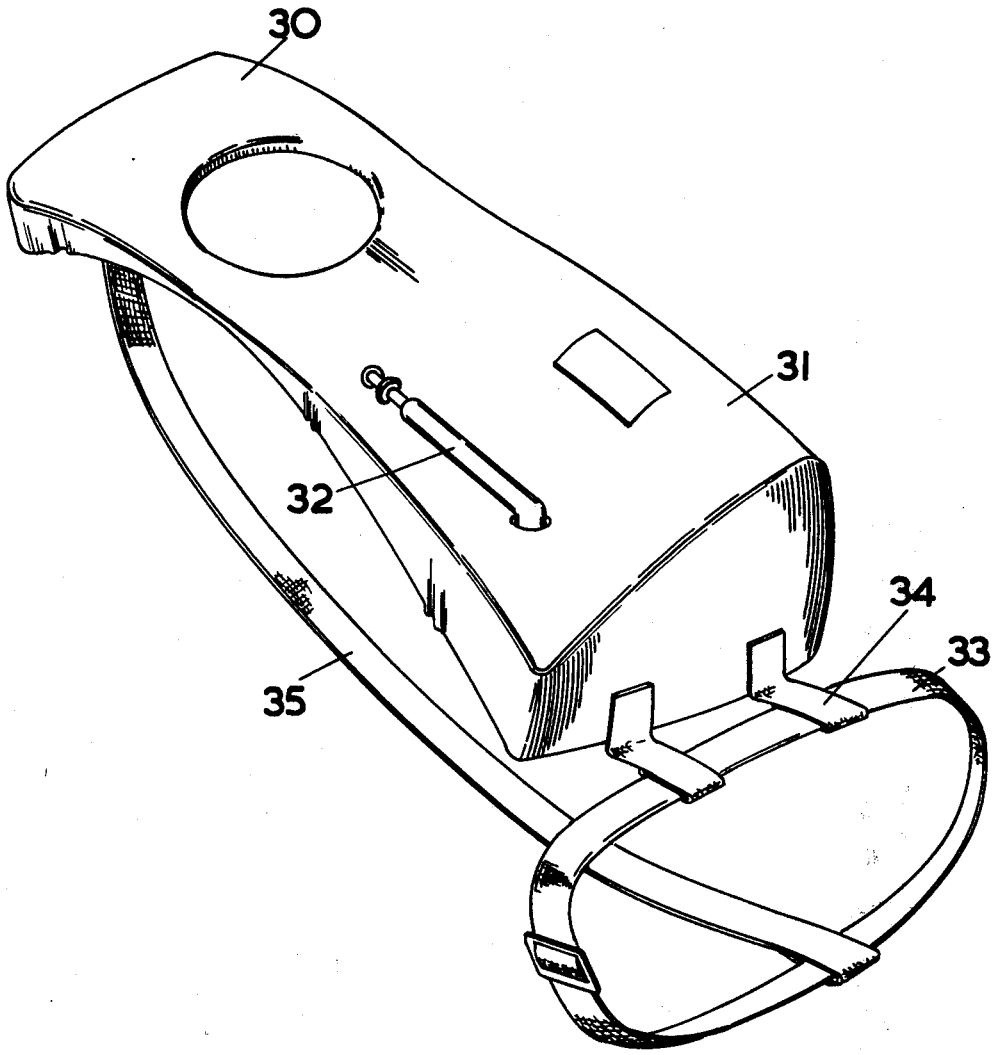
FIG. 3 is a perspective view of a collar and chest bag type stole.

The stole shown in FIG. 3 has a collar lobe 30, a chest lobe 31, and a filler 32. The chest lobe 31 is somewhat trapezoidal in cross section so that its capacity is larger on the left side than the right. As it is formed with a side wall to conform roughly to the shape of the human chest, and is symmetrical in plan view and section, it has a symmetrical displacement in normal use. A harness to it includes a torso belt 33 to which the chest lobe is attached by links 34 at the lobe extremity. A link 35 associated with the belt 33 restrains the collar lobe 30.

I claim:

1. An inflatable flotation stole comprising a collar and a chest, the chest having a rear surface for contacting the chest area of a wearer, a front surface extending outward from the wearer and side surfaces connecting said front and rear surfaces to define a flotation cavity, the cavity having portions on either side of a center plane passing through the front and rear surfaces with the front surface on one side extending further outward from the rear surface than the front surface on the other side so that the portion on said one side has a greater capacity than the portion on said other side, the volume of the portion on said one side being greater than the volume of the portion on said other side between (a) a second plane transverse to said center plane and passing through both said portions, and (b) said front surface so that a wearer face down in the water is subjected to sufficient turning moment to position him face up, and the volume of said portion on said one side being equal to the volume of said portion on said other side between (c) said second plane, and (d) said rear surface so that a wearer face up in the water will lie in a substantially symmetrical configuration.

2. A flotation stole in accordance with claim 1, in which said one portion has between 20% and 100% greater capacity than said other portion.

3. A flotation stole in accordance with claim 1 and which is a halter type stole having a collar portion and two chest lobes, one chest lobe defining said one portion having a greater capacity than the other lobe defining said other portion.

4. A flotation stole in accordance with claim 1 and which is a collar and chest bag type stole having a collar lobe and a chest lobe, the chest lobe being of substantially trapezoidal cross-section so that it is lop-sided in capacity.

5. A flotation stole in accordance with claim 1 constructed from at least a back panel, a front panel and a wall panel.

6. A flotation stole in accordance with claim 1 and which is shaped to impart a body conforming facility to the stole.

7. A flotation stole in accordance with claim 1 in which said side surface is shaped to impart a body conforming facility to the stole.

8. A flotation stole in accordance with claim 1 having a strap member connecting the back of the collar portion to the lower chest portion to prevent the collar portion from rising too far up the back of the wearer's neck and head.

9. A collar and chest bag type stole comprising a collar lobe and a chest lobe, the chest lobe being of substantially trapezoidal cross-section and having between 20% and 100% greater capacity at one side than the other so that a wearer face down in the water is subjected to sufficient turning moment to position him face up, even though he may in addition be wearing clothing and an immersion suit, the stole also being constructed to be symmetrical in shape below the water level so that the wearer will lie in a substantially symmetrical configuration when face up.

* * * * *